US012298081B2

(12) United States Patent
Oka et al.

(10) Patent No.: US 12,298,081 B2
(45) Date of Patent: May 13, 2025

(54) HEAT EXCHANGER

(71) Applicant: FUJITSU GENERAL LIMITED, Kanagawa (JP)

(72) Inventors: Kotaro Oka, Kanagawa (JP); Masatoshi Watanabe, Kanagawa (JP); Yoshinari Maema, Kanagawa (JP); Ryo Takaoka, Kanagawa (JP); Shohei Nakata, Kanagawa (JP); Daiki Shimano, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 333 days.

(21) Appl. No.: 17/907,877

(22) PCT Filed: Mar. 1, 2021

(86) PCT No.: PCT/JP2021/007769
§ 371 (c)(1),
(2) Date: Aug. 29, 2022

(87) PCT Pub. No.: WO2021/182161
PCT Pub. Date: Sep. 16, 2021

(65) Prior Publication Data

US 2023/0133342 A1 May 4, 2023

(30) Foreign Application Priority Data

Mar. 10, 2020 (JP) ..... 2020-041263

(51) Int. Cl.
*F28D 1/053* (2006.01)
*F25B 39/02* (2006.01)
(Continued)

(52) U.S. Cl.
CPC ..... *F28D 1/05366* (2013.01); *F25B 39/028* (2013.01); *F25B 39/04* (2013.01);
(Continued)

(58) Field of Classification Search
CPC .... F25B 39/028; F25B 39/04; F28D 1/05366; F28F 1/02; F28F 9/02; F28F 9/0265; F28F 9/028
See application file for complete search history.

(56) References Cited

U.S. PATENT DOCUMENTS 4,903,389 A * 2/1990 Wolf ..... F28F 9/001 165/175
5,752,566 A * 5/1998 Liu ..... F25B 39/04 165/110
(Continued)

FOREIGN PATENT DOCUMENTS

CN 105593628 A 5/2016
CN 105849498 A 8/2016
(Continued)

OTHER PUBLICATIONS

Mar. 14, 2024, European Search Report issued for related EP Application No. 21767675.8.
(Continued)

*Primary Examiner* — Ljiljana V. Ciric
(74) *Attorney, Agent, or Firm* — Paratus Law Group, PLLC

(57) ABSTRACT

A heat exchanger includes a plurality of flat heat transfer tubes and a header, wherein the header includes an inflow plate that divides an interior portion of the header into an inflow portion and a circulation portion located on an upper side of the inflow portion, a first partition member that divides the circulation portion into an ascending path to which the flat heat transfer tubes are connected and a descending path, that forms an upper communication path that connects the ascending path and the descending path on an upper side of the circulation portion, and a lower communication path that connects the ascending path and the descending path on a lower side of the circulation portion,
(Continued)

and the inflow plate includes a first ejection hole that ejects, on the ascending path side and a downwind side, a refrigerant from the inflow portion to the ascending path.

5 Claims, 11 Drawing Sheets

(51) Int. Cl.
*F25B 39/04* (2006.01)
*F28F 1/02* (2006.01)
*F28F 9/02* (2006.01)

(52) U.S. Cl.
CPC ..... *F28F 1/02* (2013.01); *F28F 9/02* (2013.01); *F28F 9/0265* (2013.01); *F28F 9/028* (2013.01)

(56) References Cited

U.S. PATENT DOCUMENTS

| | | | | |
|---|---|---|---|---|
| 6,073,688 | A * | 6/2000 | Kato | F28F 9/0224 165/173 |
| 7,635,019 | B2 * | 12/2009 | Higashiyama | F28D 1/05391 165/110 |
| 8,037,929 | B2 * | 10/2011 | Higashiyama | F28F 9/0246 165/172 |
| 8,250,874 | B2 * | 8/2012 | Ikegami | F25B 13/00 62/509 |
| 9,976,820 | B2 * | 5/2018 | Okazaki | F28D 1/05383 |
| 10,006,723 | B2 * | 6/2018 | Okubo | F16L 25/0009 |
| 10,107,570 | B2 * | 10/2018 | Matsuda | F16L 41/02 |
| 10,288,363 | B2 * | 5/2019 | Matsui | F25B 39/022 |
| 11,421,947 | B2 * | 8/2022 | Matsui | F25B 39/04 |
| 2003/0116308 | A1 * | 6/2003 | Watanabe | F28F 9/0212 165/174 |
| 2012/0198882 | A1 * | 8/2012 | Takagi | F28F 1/128 62/524 |
| 2016/0238322 | A1 | 8/2016 | Inoue et al. | |
| 2016/0320135 | A1 | 11/2016 | Inoue et al. | |
| 2016/0327317 | A1 | 11/2016 | Inoue et al. | |
| 2017/0292741 | A1 | 10/2017 | Inoue et al. | |
| 2020/0025428 | A1 | 1/2020 | Inoue et al. | |
| 2020/0109902 | A1 | 4/2020 | Satou et al. | |
| 2020/0386480 | A1 | 12/2020 | Inoue et al. | |
| 2022/0196335 | A1 | 6/2022 | Watanabe et al. | |
| 2023/0085871 | A1 * | 3/2023 | Nakata | F25B 39/00 165/129 |
| 2023/0094694 | A1 * | 3/2023 | Nakata | F28F 1/04 165/175 |
| 2023/0108901 | A1 * | 4/2023 | Nakata | F28F 9/0265 165/175 |
| 2023/0133342 | A1 * | 5/2023 | Oka | F25B 39/04 165/177 |
| 2023/0288145 | A1 * | 9/2023 | Maema | F28F 9/0275 |
| 2023/0358451 | A1 * | 11/2023 | Takahashi | F28F 9/0278 |

FOREIGN PATENT DOCUMENTS

| | | | | |
|---|---|---|---|---|
| CN | 105874297 | A | 8/2016 | |
| CN | 110476035 | A | 11/2019 | |
| CN | 113661367 | A | 11/2021 | |
| EP | 3054255 | A1 | 8/2016 | |
| EP | 3088833 | A1 * | 11/2016 | F25B 13/00 |
| EP | 3203175 | A1 | 8/2017 | |
| EP | 3605003 | A1 | 2/2020 | |
| EP | 4119867 | A1 * | 1/2023 | F25B 39/028 |
| JP | H02-219966 | A | 9/1990 | |
| JP | H11-337293 | A | 12/1999 | |
| JP | 2011-085324 | A | 4/2011 | |
| JP | 2013-061114 | A | 4/2013 | |
| JP | 2014-126273 | A | 7/2014 | |
| JP | 2015-055412 | A | 3/2015 | |
| JP | 2015-068622 | A | 4/2015 | |
| JP | 2015-127618 | A | 7/2015 | |
| JP | 5850118 | B1 | 2/2016 | |
| JP | 2016-070623 | A | 5/2016 | |
| JP | 2019-056542 | A | 4/2019 | |
| WO | WO 2009/022575 | A1 | 2/2009 | |

OTHER PUBLICATIONS

Sep. 30, 2024, Chinese Office Action issued for related CN Application No. 202180019039.6.

* cited by examiner

HEAT EXCHANGER

CROSS REFERENCE TO PRIOR APPLICATION

This application is a National Stage Patent Application of PCT International Patent Application No. PCT/JP2021/007769 (filed on Mar. 1, 2021) under 35 U.S.C. § 371, which claims priority to Japanese Patent Application No. 2020-041263 (filed on Mar. 10, 2020), which are all hereby incorporated by reference in their entirety.

FIELD

The disclosed technology relates to a heat exchanger.

BACKGROUND

In general, a heat exchanger used for an air conditioner has a structure in which both ends of a plurality of flat heat transfer tubes having channels are connected to one of associated headers and the other of associated headers and performs branching a flow of a refrigerant from the one header to each of the flat heat transfer tubes. For example, a technology for circulating a refrigerant in an interior portion of the header and uniformly distributing the refrigerant to the plurality of flat heat transfer tubes that are connected to the header has been proposed (see Patent Literature 1).

CITATION LIST

Patent Literature

Patent Literature 1: Japanese Laid-open Patent Publication No. 2015-127618

SUMMARY

Technical Problem

However, in the interior of each of the flat heat transfer tubes, a heat exchange amount is different between channels disposed on an upwind side and a downwind side. As a result, a state of the refrigerant is not uniform among the plurality of channels included in the respective flat heat transfer tubes, and thus, performance of heat exchange may sometimes be decreased.

The disclosed technology has been conceived in light of the circumstances described above and an object thereof is to provide a heat exchanger capable of performing branching a flow of a refrigerant in consideration of a difference of a heat exchange amount between the channels disposed on the upwind side and the downwind side with respect to each of the flat heat transfer tubes.

Solution to Problem

According to an aspect of an embodiment, a heat exchanger includes a plurality of flat heat transfer tubes that are aligned at intervals, and a header that has a hollow shape and to which end portions of the plurality of flat heat transfer tubes are connected, wherein the header includes an inflow plate that divides an interior portion of the header into an inflow portion in which a refrigerant flows in and a circulation portion that is located on an upper side of the inflow portion and to which the end portions of the plurality of flat heat transfer tubes are connected, and a first partition member that divides the circulation portion into an ascending path that is located on an inner side that is a side to which the end portions of the plurality of flat heat transfer tubes are connected and a descending path that is located on an outer side disposed on an opposite side of the inner side, that forms an upper communication path that communicates the ascending path and the descending path on an upper side of an interior portion of the circulation portion, and that forms a lower communication path that communicates the ascending path and the descending path on a lower side of the interior portion of the circulation portion, and the inflow plate includes at least one first ejection hole that ejects, on the ascending path side and a downwind side, a refrigerant from the inflow portion to the ascending path.

Advantageous Effects of Invention

The heat exchanger according to the present disclosure is able to perform branching a flow of a refrigerant in consideration of a difference of a heat exchange amount between the channels disposed on the upwind side and the downwind side with respect to each of the flat heat transfer tubes.

DESCRIPTION OF EMBODIMENTS

Figure 1:
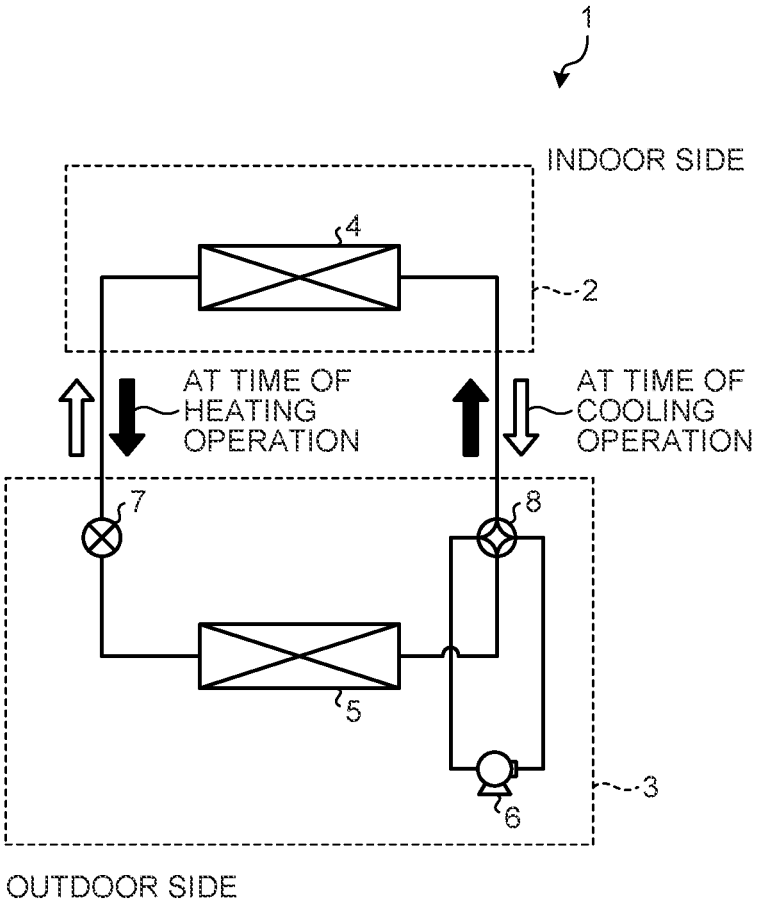
FIG. 1 is a diagram illustrating a configuration of an air conditioner in which heat exchangers according to a first embodiment are applied.

Preferred embodiments of a rotor and an electric motor disclosed in the present invention will be described in detail below with reference to the accompanying drawings. In addition, components that are the same as those in the embodiments are assigned the same reference numerals.

First Embodiment

Air Conditioner

FIG. 1 is a diagram illustrating a configuration of an air conditioner 1 in which a heat exchanger 4 and a heat exchanger 5 according to a first embodiment are applied. As illustrated in FIG. 1, the air conditioner 1 includes an indoor unit 2 and an outdoor unit 3. The indoor unit 2 is provided with the heat exchanger 4 for an indoor use, whereas the outdoor unit 3 is provided with, in addition to the heat exchanger 5 for an outdoor use, a compressor 6, an expansion valve 7, and a four-way valve 8.

At the time of a heating operation, a high-temperature high-pressure gas refrigerant discharged from the compressor 6 included in the outdoor unit 3 flows into the heat exchanger 4 that functions as a condenser via the four-way valve 8. At the time of the heating operation, the refrigerant flows in the direction indicated by the black arrow illustrated in FIG. 1. In the heat exchanger 4, the refrigerant that has been subjected to heat exchange with external air is liquefied. The liquefied high pressure refrigerant is decompressed after passing through the expansion valve 7 and flows, as a low-temperature low-pressure gas-liquid two-phase refrigerant, into the heat exchanger 5 that functions as an evaporator. In the heat exchanger 5, the refrigerant that has been subjected to heat exchange with the external air is gasified. The gasified low pressure refrigerant is taken into the compressor 6 via the four-way valve 8.

At the time of a cooling operation, a high-temperature high-pressure gas refrigerant discharged from the compressor 6 included in the outdoor unit 3 flows into the heat exchanger 5 that functions as a condenser via the four-way valve 8. At the time of the cooling operation, the refrigerant flows in the direction indicated by the white arrow illustrated in FIG. 1. In the heat exchanger 5, the refrigerant that has been subjected to heat exchange with external air is liquefied. The liquefied high pressure refrigerant is decompressed by passing through the expansion valve 7 and flows, as a low-temperature low-pressure gas-liquid two-phase refrigerant, into the heat exchanger 4 that functions as an evaporator. In the heat exchanger 4, the refrigerant that has been subjected to heat exchange with the external air is gasified. The gasified low pressure refrigerant is taken into the compressor 6 via the four-way valve 8.

Heat Exchanger

The heat exchanger according to the first embodiment is applicable to both of the heat exchanger 4 and the heat exchanger 5. In a description below, to give specific details, a description will be made with the assumption that the heat exchanger according to the first embodiment is applied to the heat exchanger 5 that functions as an evaporator at the time of the heating operation.

Figure 2A:
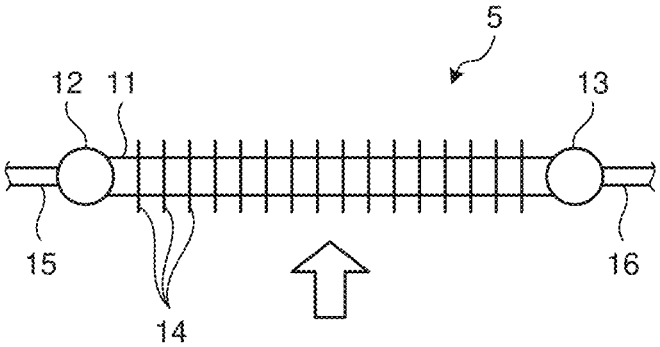
FIG. 2A is a plan view of the heat exchanger.
Figure 2B:
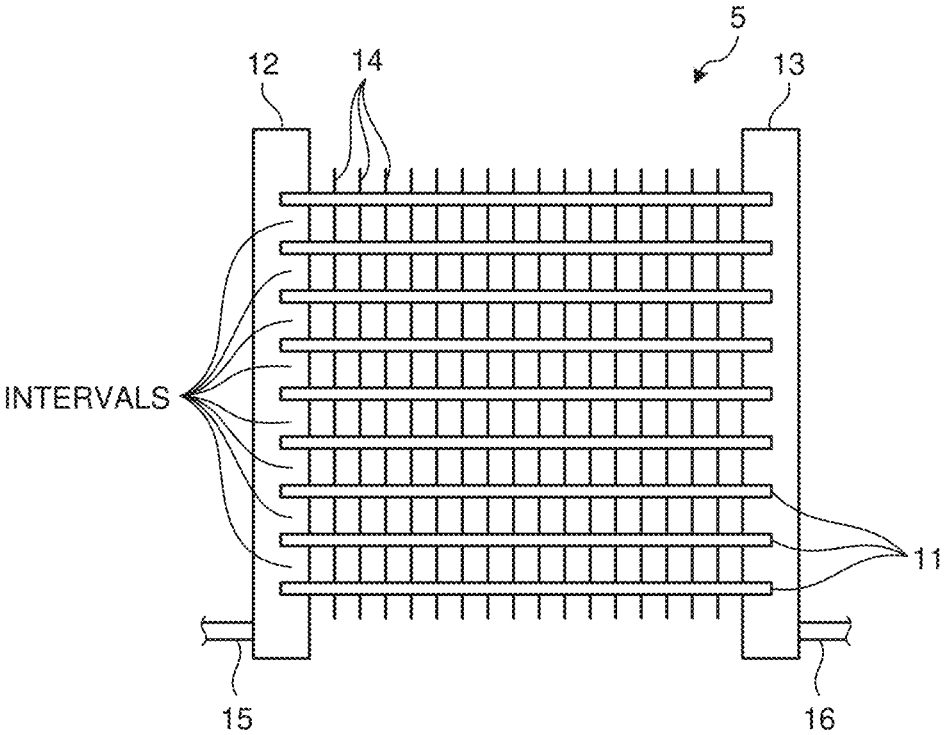
FIG. 2B is a front view of the heat exchanger.

FIG. 2A is a plan view of the heat exchanger 5, and FIG. 2B is a front view of the heat exchanger 5. The heat exchanger 5 includes a plurality of flat heat transfer tubes 11, a header 12, a header 13, and fins 14.

The low-temperature low-pressure gas-liquid two-phase refrigerant that is decompressed by passing through the expansion valve 7 is supplied to the header 12 by a pipe 15 and flows into each of the flat heat transfer tubes 11 by being branched off. At the time of flowing in the flat heat transfer tube 11, the gas-liquid two-phase refrigerant that has been subjected to heat exchange with the air via the fins 14 is gasified and flows out to the header 13, and the refrigerant that has been joined at the header 13 is taken into the compressor 6 via a pipe 16 and the four-way valve 8. In the following, a specific configuration of the plurality of flat heat transfer tubes 11, the header 12, the header 13, and the fins 14 will be described.

The plurality of flat heat transfer tubes 11 are conducting tubes that are formed in a flat shape in cross section and that have a plurality of channels that are disposed along a direction in which the flat heat transfer tubes extend and that are used to allow a refrigerant to flow into the interior portion of the flat heat transfer tubes 11. The plurality of flat heat transfer tubes 11 are aligned at intervals along a vertical direction of each of the header 12 and the header 13 such that the flat heat transfer tubes 11 face with each other in the width direction. An end of each of the plurality of flat heat transfer tubes 11 is connected to the header 12, whereas the other end of each of the plurality of flat heat transfer tubes 11 is connected to the header 13.

The refrigerant that is branched off from the header 12 to each of the flat heat transfer tubes 11 flows through the channel located in the interior portion of each of the flat heat transfer tubes 11 and flows out to the header 13. The refrigerant flowing through the channel located in the interior portion of each of the flat heat transfer tubes 11 performs heat exchange with external air that passes through the space between the plurality of flat heat transfer tubes 11. In a description below, a flow of the external air on the upstream side is referred to as upwind, whereas on the downstream side is referred to as downwind.

Furthermore, in FIG. 2B or the like, a case in which the number of the flat heat transfer tubes 11 is nine is illustrated. However, this is only an example and the number of the flat heat transfer tubes 11 is not limited to nine.

The header 12 is a refrigerant channel having a tubular shape (for example, a cylindrical shape). The interior portion of the header 12 is formed to have a hollow shape such that a refrigerant is branched off and flows into the plurality of flat heat transfer tubes 11. The end portion of each of the plurality of flat heat transfer tubes 11 is connected to the pipe 15 at the header 12. The refrigerant flowing into the header 12 via the pipe 15 is branched off and flows into each of the flat heat transfer tubes 11 in the header 12.

Figure 3:
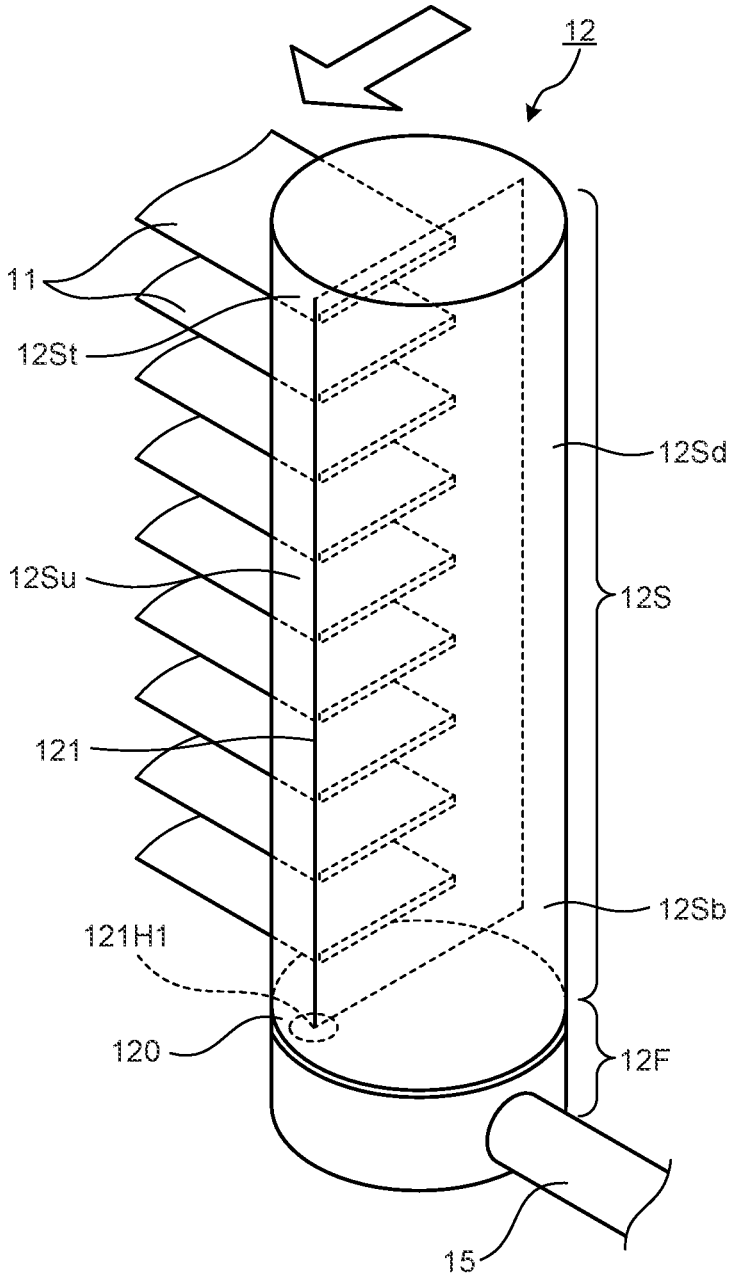
FIG. 3 is a perspective view of a header of the heat exchanger according to the first embodiment.

FIG. 3 is a perspective view of the header 12 included in the heat exchanger 5 according to the first embodiment. As illustrated in FIG. 3, the header 12 includes an inflow plate 120 and a first partition member 121. Furthermore, in a description below, in the header 12, the side on which the end portion of each of the plurality of flat heat transfer tubes 11 is connected is referred to as an inner side, whereas the side that is an opposite side of the inner side and to which the end portion of each of the plurality of flat heat transfer tubes 11 is not connected is referred to as an outer side. In addition, in FIG. 3, the arrow indicates a flowing direction of the external air and an illustration of the fins 14 is omitted.

The inflow plate 120 divides the interior portion of the header 12 into an inflow portion 12F and a circulation portion 12S that is located on the upper side of the inflow portion 12F. The pipe 15 is connected to the inflow portion 12F. The end portions of the plurality of flat heat transfer tubes 11 are connected to the circulation portion 12S.

The first partition member 121 is provided in the interior portion of the header 12 along the longitudinal direction (i.e., in an aligning direction of the flat heat transfer tubes 11) of the header 12 that has a tubular shape. The first partition member 12S divides the circulation portion S into an ascending path 12Su that is located on the inner side and a descending path 12Sd that is located on the outer side.

Furthermore, the cross-sectional area of each of the ascending path 12Su and the descending path 12Sd is able to be designed in advance in accordance with the state or the type of the flowing refrigerant. These items may be appropriately set in accordance with the performance needed for the heat exchanger 5.

Furthermore, the first partition member 121 is provided at a distance from each of the upper surface and the bottom surface of the header 12. The first partition member 121 forms an upper communication path 12St that communicates the ascending path 12Su and the descending path 12Sd on the upper side of the interior portion of the circulation portion 12S. Furthermore, the first partition member 121 forms a lower communication path 12Sb that communicates the ascending path 12Su and the descending path 12Sd on the lower side of the interior portion of the circulation portion 12S.

Here, the upper end of the first partition member 121 is located above the uppermost flat heat transfer tube 11 out of the plurality of flat heat transfer tubes 11. The lower end of the first partition member 121 is located below the lowermost flat heat transfer tube 11 out of the plurality of flat heat transfer tubes 11.

The inflow plate 120 includes, on the ascending path 12Su side and the downwind side, at least one first ejection hole (orifice) 121H1 that ejects a refrigerant from the inflow portion 12F to the ascending path 12Su. Furthermore, the first ejection hole 121H1 is located, when viewed from the top, between the first partition member 121 and the end portions of the plurality of flat heat transfer tubes 11. In this way, the first ejection hole 121H1 is disposed at a position that does not overlap with the end portion of the plurality of flat heat transfer tubes 11, so that it is possible to suppress deceleration of the refrigerant ejected from the first ejection hole 121H1 to the circulation portion 12S by the plurality of flat heat transfer tubes 11.

Furthermore, in FIG. 3, a case in which a single piece of the first ejection hole 121H1 is formed in the inflow plate 120 has been illustrated. In contrast, a plurality of the first ejection holes 121H1 may be formed in the inflow plate 120. Furthermore, the number of or the size (cross-sectional area) of the first ejection hole 121H1 may be designed in advance in accordance with the state or the type of a flowing refrigerant. These items may be appropriately set in accordance with the performance needed for the heat exchanger 5.

Furthermore, the inflow plate 120 may include, on the ascending path 12Su side and on the upwind side with respect to the first ejection hole 121H1, at least one second ejection hole that ejects a refrigerant from the inflow portion 12F to the ascending path 12Su. The second ejection hole is formed to be smaller than the first ejection hole 121H1. In other words, the first ejection hole 121H1 is formed to be larger than the second ejection hole.

Figure 4:
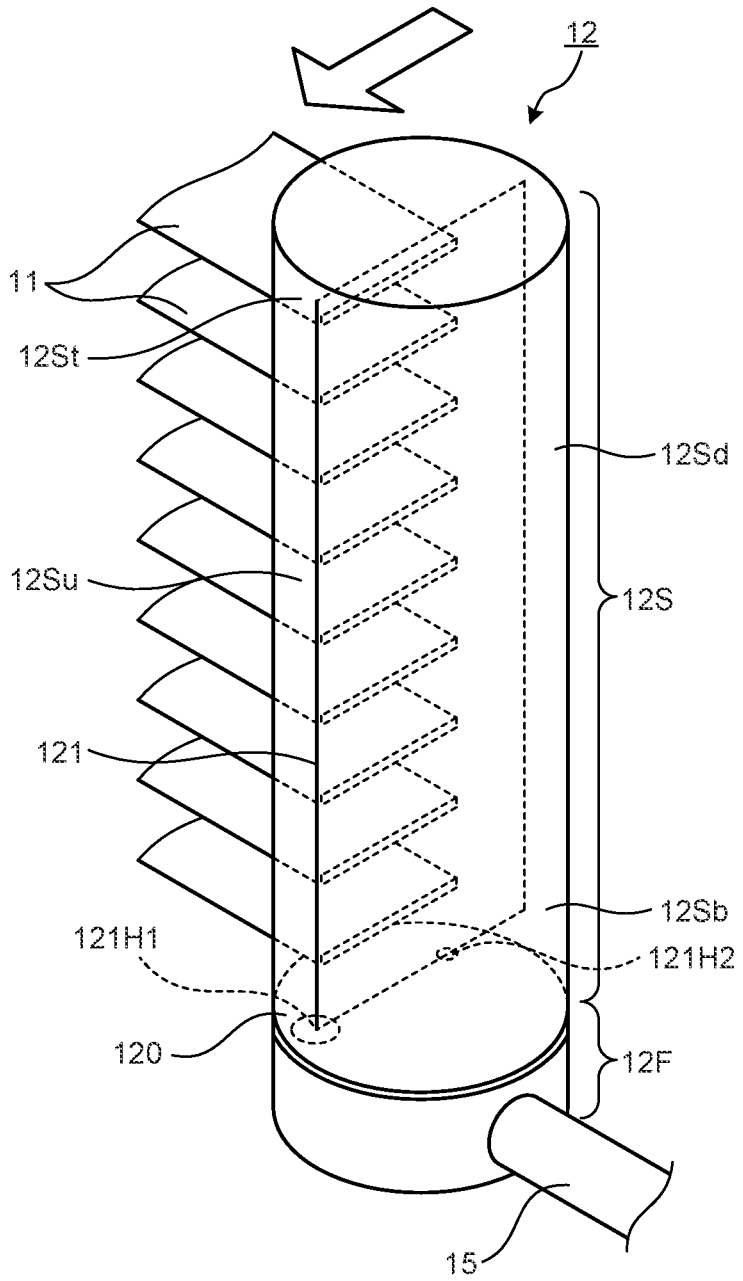
FIG. 4 is a diagram illustrating an inflow plate having two ejection holes.

FIG. 4 is a diagram illustrating the inflow plate 120 having a second ejection hole 121H2. As illustrated in FIG. 4, the first ejection hole 121H1 disposed on the downwind side is formed larger than the second ejection hole 121H2 disposed on the upwind side.

As illustrated in FIG. 2A, FIG. 2B, and FIG. 3, the header 13 is a refrigerant channel that has a tubular shape (for example, a cylindrical shape) and that is paired with the header 12. The header 13 has substantially the same configuration as that of the header 12. The other end of each of the pipe 16 and the plurality of flat heat transfer tubes 11 is connected to the header 13. The other end of each of the plurality of flat heat transfer tubes 11 is connected, and the refrigerant that flows out from each of the flat heat transfer tubes 11 joins in the interior of the header 13.

The fins 14 extend in a direction intersecting the plurality of flat heat transfer tubes 11 and is bonded to the plurality of flat heat transfer tubes 11. The fins 14 are arrayed, along the longitudinal direction of the plurality of flat heat transfer tubes 11, at a predetermined pitch with a space therebetween through which air passes.

Circulation of Refrigerant Performed in Header

In the following, circulation of a refrigerant performed in the header will be described. In addition, in a description below, to give specific details, the header 12 is used as an example.

Figure 5:
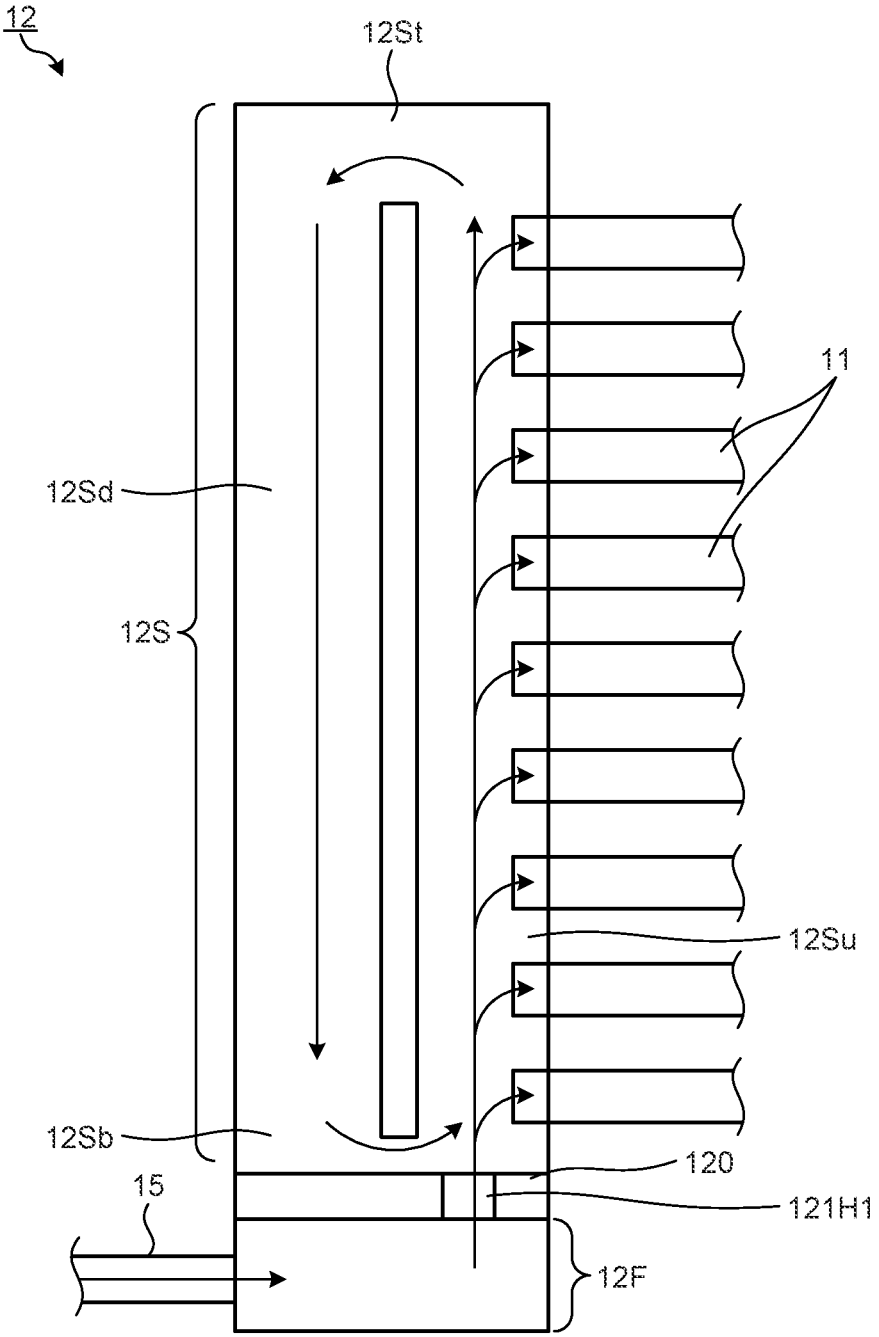
FIG. 5 is a cross-sectional view illustrating the header and a part of a plurality of flat heat transfer tubes viewed from an upwind side.
Figure 6:
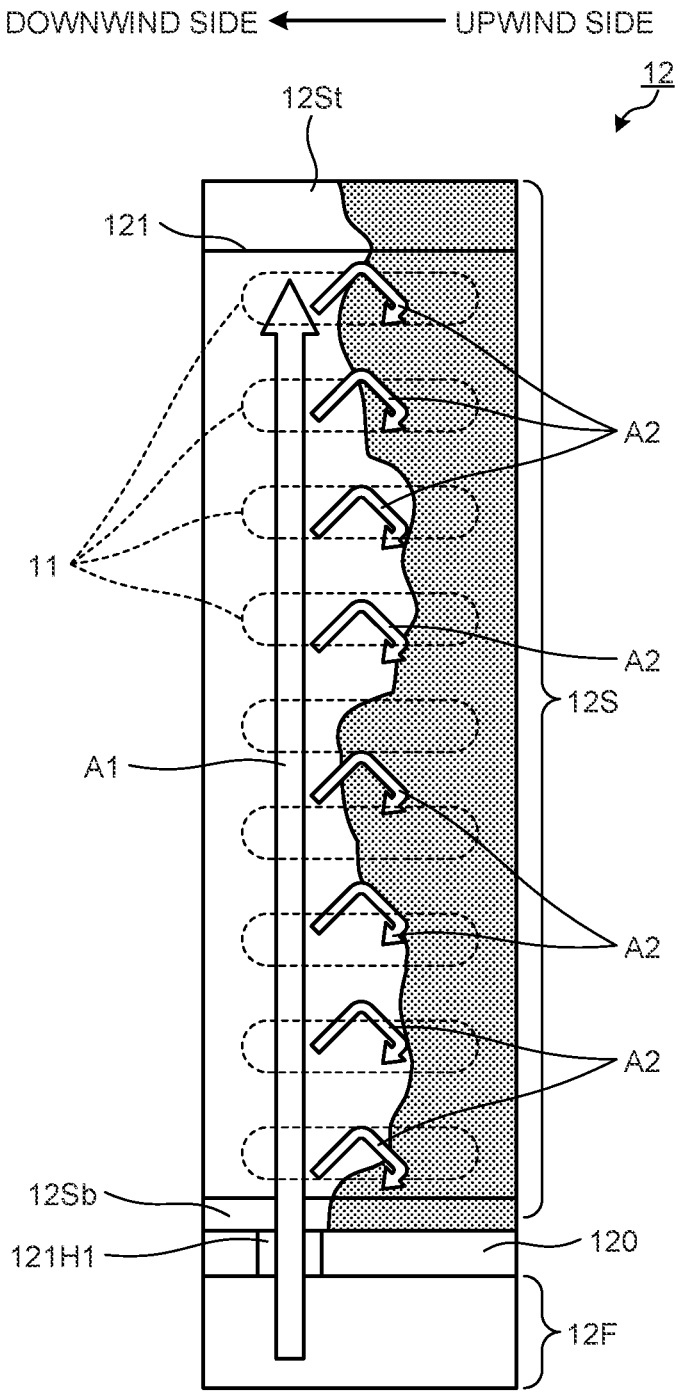
FIG. 6 is a cross-sectional view illustrating the header viewed from the plurality of flat heat transfer tubes side.

FIG. 5 and FIG. 6 are diagrams each illustrating circulation of a refrigerant performed in the header 12. FIG. 5 indicates a cross-sectional view of the header 12 and a part of the plurality of flat heat transfer tubes 11 viewed from the upwind side. Furthermore, FIG. 6 indicates a cross-sectional view of the header 12 viewed from the plurality of flat heat transfer tubes 11 side. In addition, in FIG. 6, the dotted area of the circulation portion 12S schematically indicates a distribution of a liquid refrigerant, whereas the solid white area of the circulation portion 12S schematically indicates a distribution of a gas refrigerant. Furthermore, in FIG. 5 and FIG. 6, an illustration of the fins 14 is omitted.

As illustrated in FIG. 5, the refrigerant (gas-liquid two-phase refrigerant) supplied from the pipe 15 to the inflow portion 12F is ejected to the circulation portion 12S via the first ejection hole 121H1 included in the inflow plate 120. The first ejection hole 121H1 is formed, in the inflow portion 12F, on the ascending path 12Su side and the downwind side. Accordingly, as indicated by an arrow A1 illustrated in FIG. 6, the refrigerant ejected from the first ejection hole 121H1 to the circulation portion 12S ascends on the downwind side of the ascending path 12Su.

In other words, the refrigerant ejected from the first ejection hole 121H1 to the ascending path 12Su of the circulation portion 12S is a gas-liquid two-phase refrigerant that is a combination of a liquid refrigerant and a gas refrigerant; however, the flow velocity of the gas refrigerant is higher than that of the liquid refrigerant. As a result, if the refrigerant is ejected from the first ejection hole 121H1 to the downwind side of the ascending path 12Su and ascends, most of the gas refrigerant vigorously flows, as indicated by the arrow A1 illustrated in FIG. 6, from the first ejection hole 121H1 toward an upper part of the downwind side of the ascending path 12Su.

In contrast, as indicated by the arrow A2 illustrated in FIG. 6, the liquid refrigerant flowing at a low flow velocity is pushed out from the downwind side to the upwind side due to an air current of the gas refrigerant ejected from the first ejection hole 121H1. As a result, as illustrated in FIG. 6, a large amount of a gas refrigerant that has been blown up and that flows at a high flow velocity is distributed on the downwind side of the ascending path 12Su, whereas a large amount of a liquid refrigerant that flows at a flow velocity that is lower than that of the gas refrigerant is distributed on the upwind side of the ascending path 12Su.

In the ascending path 12Su, the refrigerant exhibiting a phase distribution illustrated in FIG. 6 is branched off and flows into the plurality of flat heat transfer tubes 11. When the refrigerant that is branched off and flows into the plurality of flat heat transfer tubes 11 flows through each of the flat heat transfer tubes 11, the refrigerant that has been subjected to heat exchange with air via the fins 14 is gasified and flows out to the header 13.

In addition, the refrigerant that is not branched off and does not flow into the plurality of flat heat transfer tubes 11 inverts its vertical flow direction in the upper communication path 12St and flows into the descending path 12Sd of the circulation portion 12S. The refrigerant flowing into the descending path 12Sd descends the descending path 12Sd of the circulation portion 12S, inverts its vertical flow direction in the lower communication path 12Sb, and again flows into the ascending path 12Su.

The refrigerant flowing into the ascending path 12Su as described above is joined with a refrigerant that is newly ejected from the first ejection hole 121H1 to the circulation portion 12S and repeats the same circulation as described above.

As described above, by providing the first ejection hole 121H1 on the ascending path 12Su side of the inflow plate 120 and the downwind side, it is possible to vigorously flow the gas refrigerant to above the ascending path 12Su. By using the ascending flow on the downwind side of the gas refrigerant, as illustrated in FIG. 6, it is possible to change the flow ratio of the gas refrigerant to the liquid refrigerant related in the width direction of each of the plurality of flat heat transfer tubes 11. Specifically, it is possible to allow a larger amount of the liquid refrigerant, out of the gas-liquid two-phase refrigerants, to branch off and flow through each of the flat heat transfer tubes 11 on the upwind side in which an amount of heat exchanged is large and allow a larger amount of the gas refrigerant to branch off and flow on the downwind side in which an amount of heat exchanged is less than that on the upwind side. Furthermore, in the present embodiment, in this way, an effect in which the ratio of gas refrigerant to the liquid refrigerant related to the plurality of flat heat transfer tubes 11 in the width direction is made to vary is referred to as a bias effect of the refrigerant phase distribution.

Furthermore, the bias effect of the refrigerant phase distribution as described above is also applied to the flat heat transfer tubes 11 located on the upper portion of the header 12 because the gas refrigerant is vigorously ejected from the first ejection hole 121H1 to an upper part of the ascending path 12Su. In addition, it is possible to suppress the liquid refrigerant from flowing into the lowermost flat heat transfer tube 11 because the liquid refrigerant is vigorously ejected from the first ejection hole 121H1 to an upper part of the ascending path 12Su together with the gas refrigerant.

Furthermore, it is conceivable that a case in which the inflow plate 120 is provided with the second ejection hole 121H2 on the upwind side and the first ejection hole 121H1 on the downwind side (see FIG. 4). By providing the second ejection hole 121H2, it is possible to push up the liquid refrigerant that is likely to be retained on the upwind side of the upper surface of the inflow plate 120 by using the gas refrigerant that has been ejected from the second ejection hole 121H2, and it is thus possible to suppress a bias of an amount of the refrigerant that is allowed to flow into the plurality of flat heat transfer tubes 11. In this case, the first ejection hole 121H1 disposed on the downwind side is formed to be larger than the second ejection hole 121H2 disposed on the upwind side. In general, an amount of the refrigerant flowing from each of the first ejection hole 121H1 disposed on the downwind side and the second ejection hole 121H2 disposed on the upwind side into the circulation portion 12S is in proportion to the respective opening areas. Accordingly, it is possible to increase an ejection amount of the refrigerant ejected from the first ejection hole 121H1 disposed on the downwind side as compared to an ejection amount of the refrigerant ejected from the second ejection hole 121H2 disposed on the upwind side. As a result, even when the inflow plate 120 is provided with the second ejection hole 121H2 on the upwind side and the first ejection hole 121H1 on the downwind side, it is possible to allow a large amount of the liquid refrigerant out of the gas-liquid two-phase refrigerant to branch off and flow on the upwind side in which an amount of heat exchanged is large and allow a larger amount of gas refrigerant to off and flow on the downwind side in which an amount of heat exchanged is less than that on the upwind side.

As described above, with the heat exchanger 5 according to the first embodiment, it is possible to branch off and flow a refrigerant through each of the flat heat transfer tubes 11 in consideration of a difference of an amount of heat exchanged between the channels that are disposed on the upwind side and the downwind side.

Second Embodiment

In the following, a heat exchanger according to a second embodiment will be described.

Figure 7:
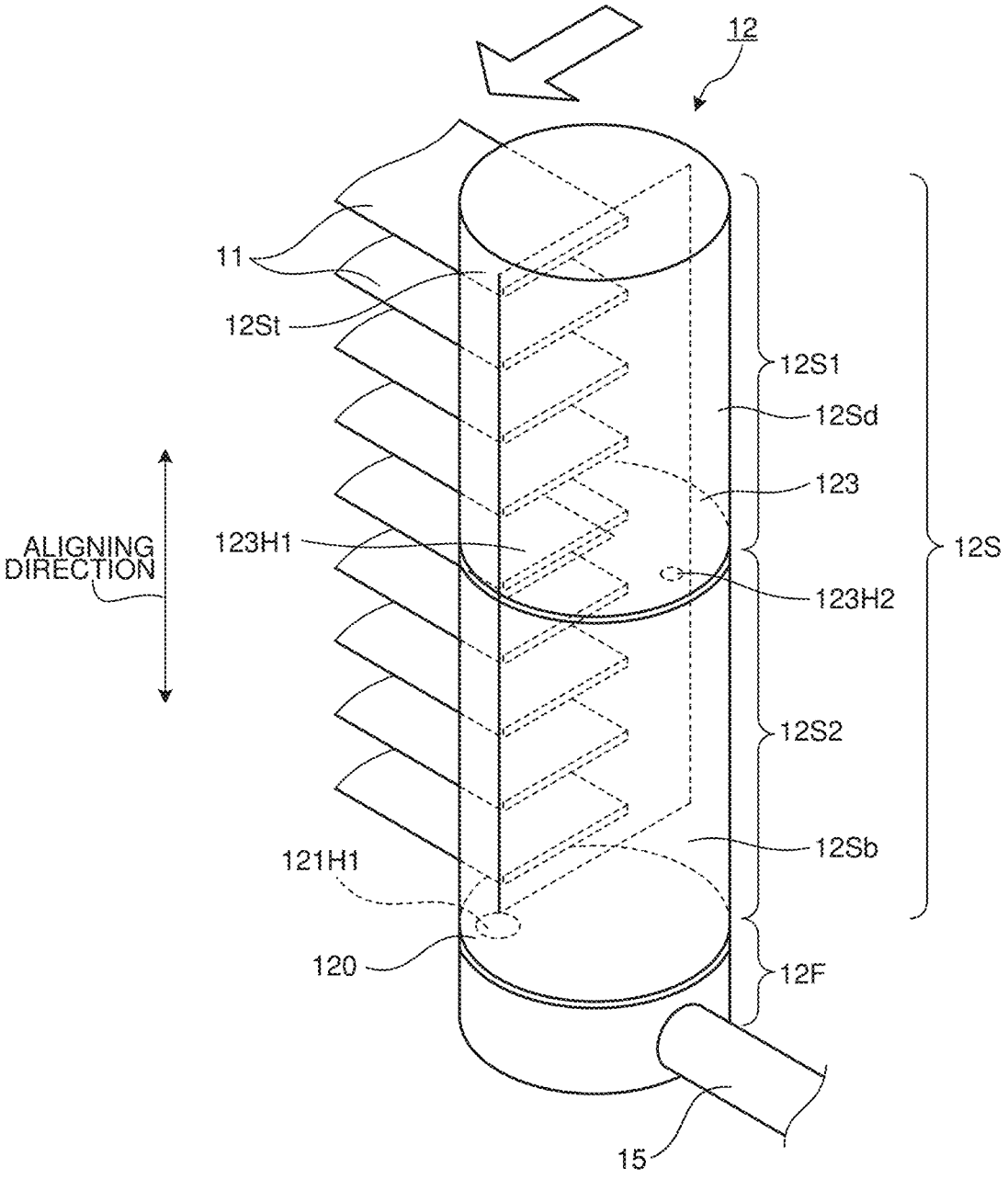
FIG. 7 is a perspective view of a header included in a heat exchanger according to a second embodiment.
Figure 8:
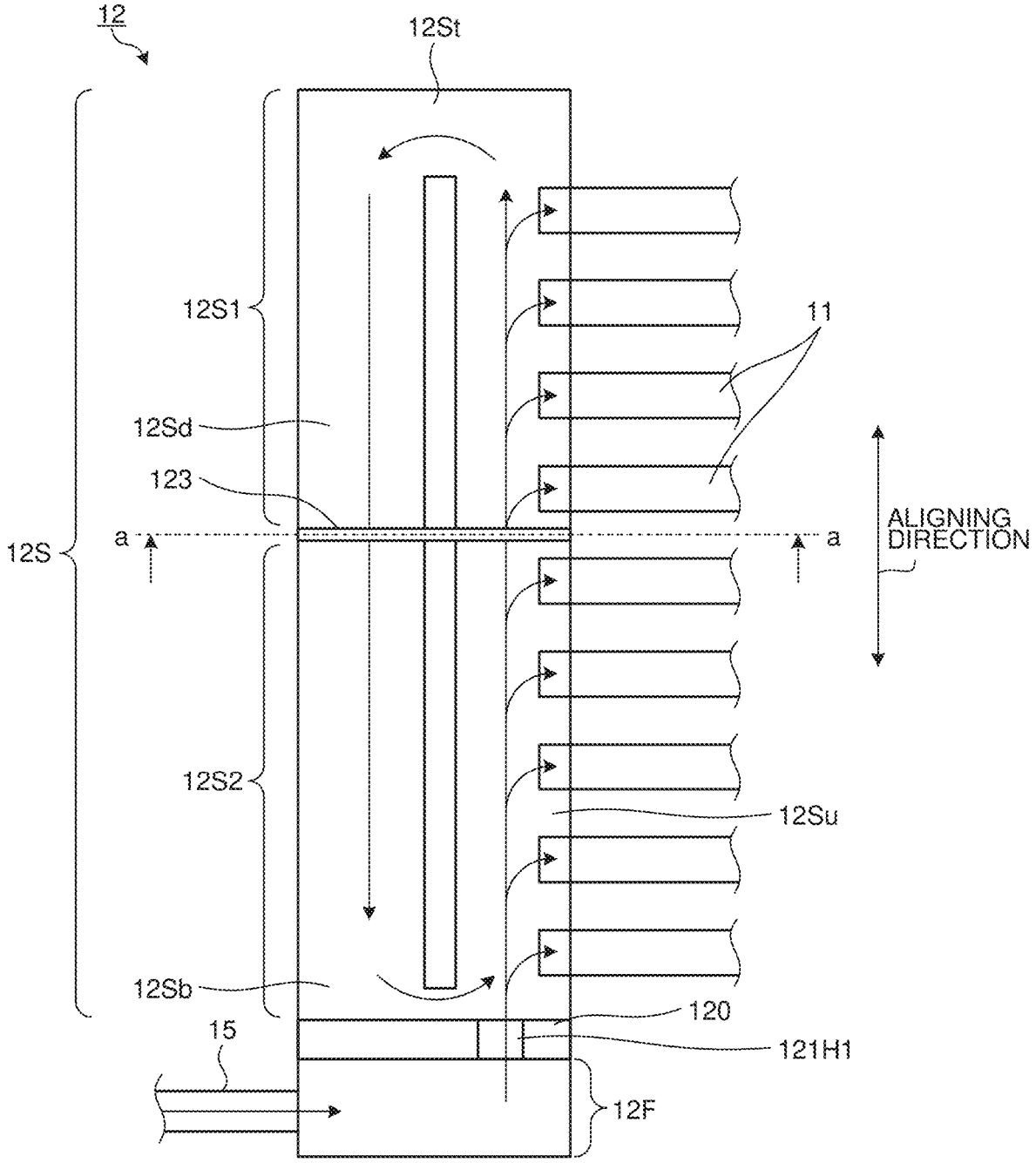
FIG. 8 is a cross-sectional view of the header included in the heat exchanger according to the second embodiment viewed from an upwind direction.

FIG. 7 is a perspective view of the header 12 included in the heat exchanger 5 according to the second embodiment. FIG. 8 is a cross-sectional view of the header 12 included in the heat exchanger 5 according to the second embodiment when viewed from the upwind direction. As illustrated in FIG. 7 and FIG. 8, the heat exchanger 5 according to the second embodiment has a configuration in which, in addition to the heat exchanger 5 according to the first embodiment, a second partition member is further provided in the circulation portion 12S included in the header 12.

A second partition member 123 divides the circulation portion 12S included in the header 12 into an upper circulation portion 12S1 that is located on the upper side and a lower circulation portion 12S2 that is located on the lower side. The second partition member 123 is provided at the center of the circulation portion 12S or above the center in the aligning direction of, for example, the plurality of flat heat transfer tubes 11 (in the longitudinal direction of the header 12 in FIG. 7 and FIG. 8).

Furthermore, in FIG. 7 and FIG. 8, the number of the flat heat transfer tubes 11 connected to the upper circulation portion 12S1 is set to be four, whereas the number of the flat heat transfer tubes 11 connected to the lower circulation portion 12S2 is set to be five. However, this is only an example and the number of the flat heat transfer tubes 11 connected to the upper circulation portion 12S1 and the lower circulation portion 12S2 is not limited to this example.

Figure 9A:
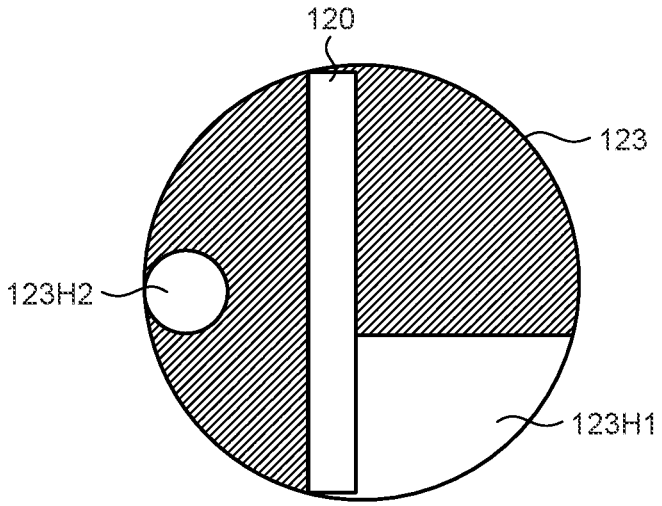
FIG. 9A is a cross-sectional view taken along a line a-a illustrated in FIG. 8.
Figure 9B:
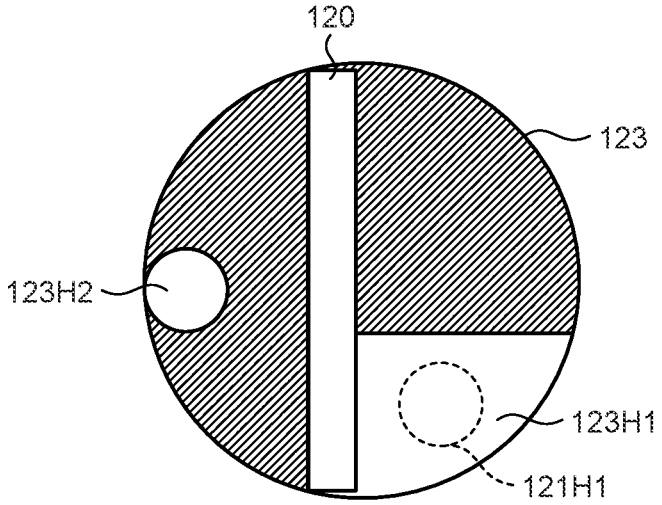
FIG. 9B is a cross-sectional view taken along the line a-a illustrated in FIG. 8.

FIG. 9A and FIG. 9B are diagrams each illustrating a cross-sectional view taken along a line a-a illustrated in FIG. 8 and are diagrams that are associated with the front view of the second partition member 123. As illustrated in FIG. 9A, the second partition member 123 includes an opening portion 123H1 on the ascending path 12Su side and the downwind side. The opening portion 123H1 ejects a refrigerant from the lower circulation portion 12S2 to the upper circulation portion 12S1. Furthermore, the second partition member 123 includes, on the descending path 12Sd side, at least one opening portion 123H2 that ejects a refrigerant from the upper circulation portion 1231 to the lower circulation portion 12S2.

Furthermore, the shape of the opening portion 123H1 may be a hole shape or a notch shape. In addition, as illustrated in FIG. 9B, the opening portion 123H1 has a positional relationship so as to be overlapped with at least one of the first ejection holes 121H1 viewed from the top. For example, the opening portion 123H1 is located above (for example, immediately above) the first ejection hole 121H1 included in the inflow plate 120. Furthermore, the size (an opening area) of the opening portion 123H1 is larger than the entire opening area of, for example, at least one of the first ejection holes 121H1.

The reason for setting the positional relationship and the size between the opening portion 123H1 and the first ejection hole 121H1 is as follows. Namely, this is because the portion other than the opening portion 123H1 included in the second partition member 123 (i.e., the plate shaped portion) does not act as channel resistance of the refrigerant that has been ejected from the first ejection hole 121H1.

Furthermore, a specific number of the opening portions 123H1 and the size thereof may be designed in advance in accordance with the state or the type of the flowing refrigerant. These items may be appropriately set in accordance with the performance needed for the heat exchanger 5.

Circulation of Refrigerant Performed in Header

In the following, a circulation of a refrigerant performed in a header will be described with reference to FIG. 8 and FIG. 10.

Figure 10:
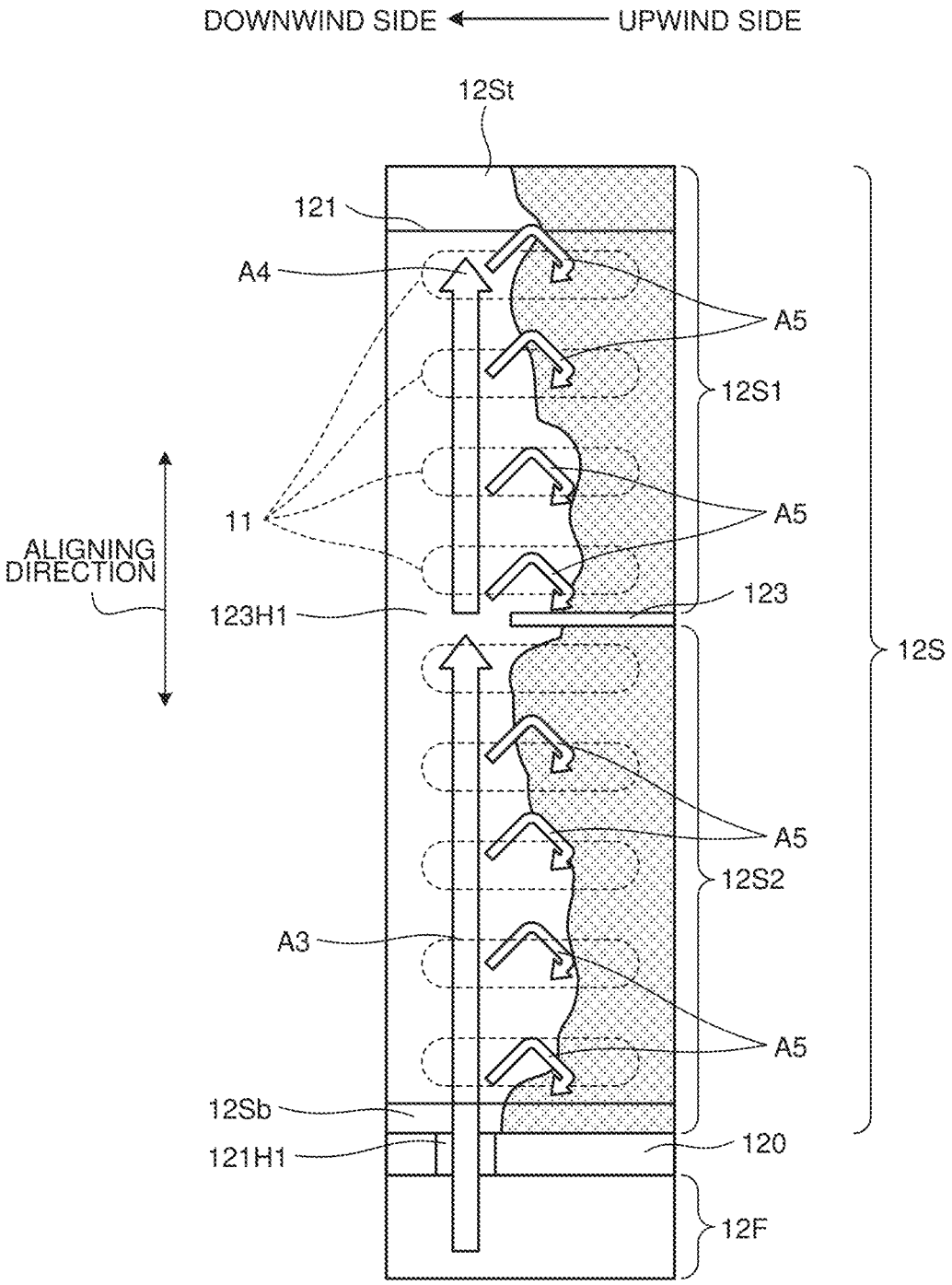
FIG. 10 is a cross-sectional view of the header viewed from the plurality of flat heat transfer tube side.

FIG. 10 is a cross-sectional view of the header 12 viewed from the plurality of flat heat transfer tubes 11 side. In addition, in also FIG. 10, similarly to FIG. 6, the dotted area of the circulation portion 12S schematically indicates a distribution of a liquid refrigerant, whereas the solid white area of the circulation portion 12S schematically indicates a distribution of a gas refrigerant. Furthermore, in FIG. 10, an illustration of the fins 14 is omitted.

As illustrated in FIG. 10, the refrigerant (gas-liquid two-phase refrigerant) supplied from the pipe 15 to the inflow portion 12F is ejected to the ascending path 12Su of the lower circulation portion 12S2 via the first ejection hole 121H1 included in the inflow plate 120. The first ejection hole 121H1 is formed, in the inflow portion 12F, on the ascending path 12Su side and the downwind side. Accordingly, the refrigerant ejected from the first ejection hole 121H1 to the ascending path 12Su of the lower circulation portion 12S2 vigorously ascends on the downwind side, as indicated by an arrow A3 illustrated in FIG. 10. The liquid refrigerant flowing at a low flow velocity is pushed out, as indicated by an arrow A5 illustrated in FIG, from the downwind side to the upwind side. 10 caused by an air current of the gas refrigerant ejected from the first ejection hole 121H1. As a result, in the lower circulation portion 12S2, the bias effect of the refrigerant phase distribution described above is implemented.

In the ascending path 12Su of the lower circulation portion 12S2, the refrigerant in which a large amount of the gas refrigerant is distributed on the downwind side and a large amount of liquid refrigerant is distributed on the upwind side is branched off and flows into the plurality of flat heat transfer tubes 11 that are connected to the lower circulation portion 12S2. When The refrigerant that is branched off and flows into the plurality of flat heat transfer tubes 11 that are connected to the lower circulation portion 12S2 flows through each of the flat heat transfer tubes 11, the refrigerant that has been subjected to heat exchange with air via the fins 14 is gasified and flows out into the header 13.

Furthermore, the refrigerant that is not branched off and does not into the plurality of flat heat transfer tubes 11 is ejected from the opening portion 123H1 of the second partition member 123 to the upper circulation portion 12S1 of the ascending path 12Su. A large amount of gas refrigerant is again accelerated by the opening portion 123H1 of the second partition member 123 and, as indicated by an arrow A4 illustrated in FIG. 10, vigorously ascends toward an upper part of the upper circulation portion 12S1. The liquid refrigerant flowing at low flow velocity is pushed out, as indicated by an arrow A5 illustrated in FIG. 10, from the downwind side to the upwind side caused by an air current of the gas refrigerant that is re-accelerated and ejected from the opening portion 123H1. As a result, in the upper circulation portion 12S1, the bias effect of the refrigerant phase distribution described above is implemented.

In the ascending path 12Su of the upper circulation portion 12S1, the refrigerant in which a large amount of the gas refrigerant is distributed on the downwind side and a large amount of the liquid refrigerant is distributed on the upwind side is branched off and flows into the plurality of flat heat transfer tubes 11 that are connected to the upper circulation portion 12S1. When the refrigerant that is branched off and flows into the plurality of flat heat transfer tubes 11 that are connected to the upper circulation portion 12S1 flows through each of the flat heat transfer tubes 11, the refrigerant that has been subjected to heat exchange with air via the fins 14 is gasified and flows out into the header 13.

Furthermore, the refrigerant that is not branched off and does not into the plurality of flat heat transfer tubes 11 that are connected to the upper circulation portion 12S1 inverts its vertical flow direction in the upper communication path 12St and flows into the descending path 12Sd of the circulation portion 12S. The refrigerant flowing into the descending path 12Sd descends the descending path 12Sd of the circulation portion 12S, inverts its vertical flow direction in the lower communication path 12Sb, and again flows into the ascending path 12Su of the lower circulation portion 12S2.

The refrigerant flowing into the ascending path 12Su of the lower circulation portion 12S2 as described above is joined with a refrigerant that is newly ejected from the first ejection hole 121H1 to the lower circulation portion 12S2 and repeats the same circulation as described above.

As described above, by providing the first ejection hole 121H1 on the ascending path 12Su side of the inflow plate 120 and the downwind side, a large amount of the gas refrigerant flowing from the lower circulation portion 12S2 to the upper circulation portion 12S1 is re-accelerated by the opening portion 123H1 of the second partition member 123. As a result, it is possible to further increase a flow ratio of gas refrigerant to liquid refrigerant in the width direction of the plurality of flat heat transfer tubes 11 at an upper part of the circulation portion 12S as compared to the case in which the second partition member 123 that includes the opening portion 123H1 is not provided. In other words, it is also possible to implement a bias effect of the refrigerant phase distribution in the upper circulation portion 12S1 without reducing the efficiency as compared to the lower circulation portion 12S2. As a result, it is possible to further efficiently perform branching a flow of the refrigerant in consideration of a difference of an amount heat exchanged between the channels that are disposed on the upwind side and the downwind side with respect to each of the flat heat transfer tubes 11.

Figure 11:
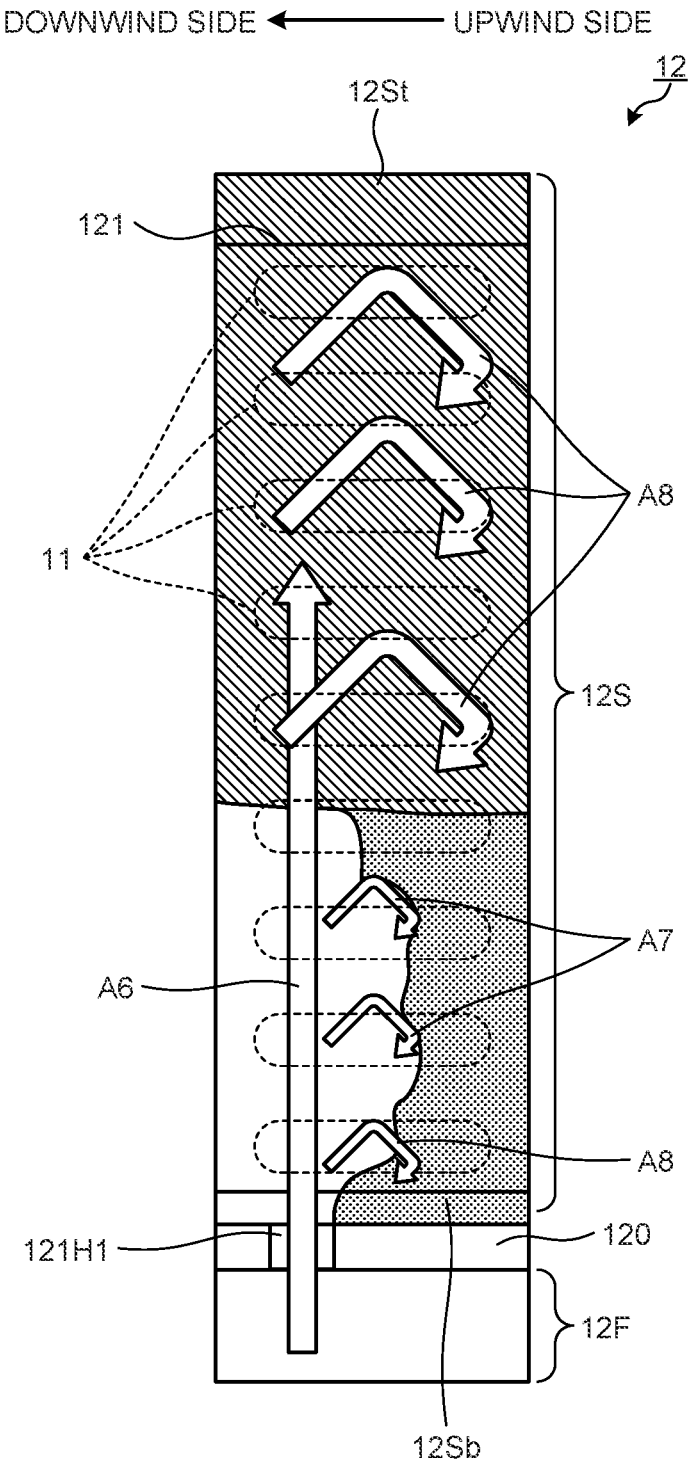
FIG. 11 is a diagram for explaining a comparative example of the header illustrated in FIG. 10.

FIG. 11 is a diagram illustrating a case in which, as a comparative example with the header illustrated in FIG. 10, a refrigerant flowing at a low circulation volume (low flow rate) is allowed to flow into the header according to the first embodiment. When the header illustrated in FIG. 11 is compared to the header illustrated in FIG. 10, in the header illustrated in FIG. 11, the second partition member 123 including the opening portion 123H1 is not present. Furthermore, in FIG. 11, an oblique line area of the ascending path 12Su of the circulation portion 12S schematically indicates a distribution of the gas-liquid two-phase refrigerant, a dotted area of the circulation portion 12S schematically indicates a distribution of the liquid refrigerant, and a solid white area of the circulation portion 12S schematically indicates a distribution of the gas refrigerant. In addition, in FIG. 11, an illustration of the fins 14 is omitted.

In the header according to the comparative example illustrated in FIG. 11, the refrigerant that has been ejected from the first ejection hole 121H1 to the ascending path 12Su of the circulation portion 12S is a low circulation volume, so that, as indicated by an arrow A6 illustrated in FIG. 11, the refrigerant loses its speed as the refrigerant ascends. As a result, a difference of the flow velocity between the upwind side and the downwind side of the ascending path 12Su of the circulation portion 12S is decreased as the refrigerant flows toward the upper portion of the circulation portion 12S. In an area closer to the first ejection hole 121H1 of the ascending path 12Su of the circulation portion 12S, as indicated by an arrow A7 illustrated in FIG. 11, it is possible to push out the liquid refrigerant flowing at low flow velocity from the downwind side to the upwind side by the gas refrigerant whose ascent velocity is high. In contrast, if the gas refrigerant loses its speed, the gas refrigerant is not able to push out the liquid refrigerant from the downwind side to the upwind side. Accordingly, as indicated by an arrow A8 illustrated in FIG. 11, a large amount of the gas-liquid two-phase refrigerant consequently flows as the refrigerant flows toward in an upward direction of the ascending path 12Su of the circulation portion 12S, so that it is conceivable that the phase distribution between the liquid refrigerant and the gas refrigerant is changed to a state in which no bias is present.

In contrast, in the heat exchanger according to the present embodiment, the bias effect of the refrigerant phase distribution acts further efficiently on the flat heat transfer tubes 11 that are located at an upper portion of the upper circulation portion 12S1 because the gas refrigerant is re-accelerated by the opening portion 123H1 and vigorously ejected to an upper part of the upper circulation portion 12S1. Furthermore, the gas refrigerant is vigorously ejected from the first ejection hole 121H1 to an upper part of the upper circulation portion 12S1, so that it is possible to suppress the liquid refrigerant from flowing into the lowermost flat heat transfer tube 11.

As described above, with the heat exchanger 5 according to the first embodiment, it is possible to perform branching a flow of the refrigerant in consideration of a difference of an amount of heat exchanged between the channels that are disposed on the upwind side and the downwind side with respect to each of the flat heat transfer tubes 11.

In the above, the embodiments have been described; however, the disclosed technology is not limited to these and may include various embodiments or the like that are not described here.

REFERENCE SIGNS LIST

1 air conditioner
2 indoor unit
3 outdoor unit
4, 5 heat exchanger
6 compressor
7 expansion valve
8 four-way valve
11 flat heat transfer tube
12, 13 header
14 fin
15, 16 pipe
12F inflow portion
12S circulation portion
12S1 upper circulation portion
12S2 lower circulation portion
12Su ascending path
12Sd descending path
12St upper communication path
12Sb lower communication path
120 inflow plate
121 first partition member
121H1 first ejection hole
121H2 second ejection hole
123 second partition member
123H1 opening portion

The invention claimed is:

1. A heat exchanger comprising:
a plurality of flat heat transfer tubes that are aligned at intervals; and
a header that has a hollow shape and to which end portions of the plurality of flat heat transfer tubes are connected, wherein
the header includes
an inflow plate that divides an interior portion of the header into an inflow portion in which a gas-liquid two-phase refrigerant flows in and a circulation portion that is located on an upper side of the inflow portion and to which the end portions of the plurality of flat heat transfer tubes are connected, and
a first partition member
that divides the circulation portion into an ascending path that is located on an inner side that is a side to which the end portions of the plurality of flat heat transfer tubes are connected and a descending path that is located on an outer side disposed on an opposite side of the inner side,
that forms an upper communication path that connects the ascending path and the descending path on an upper side of an interior portion of the circulation portion, and
that forms a lower communication path that connects the ascending path and the descending path on a lower side of the interior portion of the circulation portion, and
the inflow plate is provided with a first ejection hole that allows communication between the inflow portion and a downwind side area such that the gas-liquid two-phase refrigerant is ejected from the inflow portion to the downwind side area in a direction perpendicular to a longitudinal direction of the flat heat transfer tubes and a longitudinal direction of the header through the first ejection hole, and such that an amount of a liquid refrigerant distributed in an upwind side area is larger than an amount of a liquid refrigerant distributed in the downwind side area, the downwind side area being on a downwind side of the ascending path and the upwind side area being on an upwind side opposite to the downwind side of the ascending path.

2. The heat exchanger according to claim 1, wherein the inflow plate is further provided with a second ejection hole that allows communication between the inflow portion and the upwind side area, and
the second ejection hole has a cross-sectional area that is formed so as to be smaller than a cross-sectional area of the first ejection hole such that an amount of a refrigerant ejected from the inflow portion to the downwind side area through the first ejection hole is larger than an amount of a refrigerant ejected from the inflow portion to the upwind side area through the second ejection hole.

3. The heat exchanger according to claim 1, wherein
the header further includes a second partition member that divides the circulation portion into an upper circulation portion located on the upper side and a lower circulation portion located on the lower side, and the second partition member includes an opening portion that ejects, on the ascending path side and the downwind side, a refrigerant from the lower circulation portion to the upper circulation portion.

4. The heat exchanger according to claim 3, wherein the second partition member is provided at a center of the circulation portion or above the center in an aligning direction of the plurality of flat heat transfer tubes.

5. The heat exchanger according to claim 3, wherein the opening portion is disposed so as to overlap at least the first ejection hole when viewed from above.

* * * * *